US009924586B2

(12) United States Patent
Curry

(10) Patent No.: US 9,924,586 B2
(45) Date of Patent: Mar. 20, 2018

(54) SYSTEMS AND METHODS TO GENERATE A SELF-CONFINED HIGH DENSITY AIR PLASMA

(71) Applicant: Randy D. Curry, Columbia, MO (US)

(72) Inventor: Randy D. Curry, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 43 days.

(21) Appl. No.: 15/147,713

(22) Filed: May 5, 2016

(65) Prior Publication Data

US 2017/0064803 A1 Mar. 2, 2017

Related U.S. Application Data

(62) Division of application No. 13/491,307, filed on Jun. 7, 2012, now Pat. No. 9,338,874.

(60) Provisional application No. 61/498,281, filed on Jun. 17, 2011.

(51) Int. Cl.

| | |
|---|---|
| ***H01J 13/28*** | (2006.01) |
| ***H05H 1/24*** | (2006.01) |
| ***H05H 1/52*** | (2006.01) |
| ***H05H 1/54*** | (2006.01) |
| *H05H 1/46* | (2006.01) |

(52) U.S. Cl.
CPC ..... *H05H 1/24* (2013.01); *H05H 1/52* (2013.01); *H05H 1/54* (2013.01); *H05H 2001/4682* (2013.01); *H05H 2240/10* (2013.01)

(58) Field of Classification Search
None
See application file for complete search history.

(56) References Cited

U.S. PATENT DOCUMENTS

| | | | | |
|---|---|---|---|---|
| 4,912,367 A * | 3/1990 | Schumacher | ..... | H01J 25/005 313/231.31 |
| 2010/0308730 A1* | 12/2010 | Mohamed | ..... | H05H 1/48 315/111.21 |
| 2012/0141321 A1* | 6/2012 | Merbahi | ..... | H05H 1/48 422/22 |

FOREIGN PATENT DOCUMENTS

| | | | | |
|---|---|---|---|---|
| EP | EP 0019668 A2 * | 12/1980 | ..... | H05H 1/02 |

* cited by examiner

*Primary Examiner* — Cassandra Cox
(74) *Attorney, Agent, or Firm* — Polsinelli PC

(57) ABSTRACT

This disclosure relates to methods and devices for generating electron dense air plasmas at atmospheric pressures. In particular, this disclosure relate to self-contained toroidal air plasmas. Methods and apparatuses have been developed for generating atmospheric toroidal air plasmas. The air plasmas are self-confining, can be projected, and do not require additional support equipment once formed.

15 Claims, 6 Drawing Sheets

SYSTEMS AND METHODS TO GENERATE A SELF-CONFINED HIGH DENSITY AIR PLASMA

CROSS REFERENCE TO RELATED APPLICATIONS

This application is a divisional application of U.S. Pat. No. 9,338,874, entitled "Systems and Methods to Generate A Self-Confined High Density Air Plasma," filed Jun. 7, 2012, which claims priority to U.S. Provisional Application No. 61/498,281, entitled "Systems and Methods to Generate a High Density Air Plasma," filed on Jun. 17, 2011, both of which are incorporated herein by reference in their entireties.

FEDERALLY SPONSORED RESEARCH OR DEVELOPMENT

This invention was made with government support under grant number N00014-08-1-0266 by Office of Naval Research (Agency). The government has certain rights in the invention.

FIELD OF THE INVENTION

The present invention relates to a method and apparatus for generating self-sustaining air plasmas at atmospheric pressures.

BACKGROUND OF THE INVENTION

An air plasma is an electrically conductive state of matter composed of ions, electrons, radicals, and other neutral species formed at atmospheric pressure that exist in an independent state. Air plasmas may be used in a variety of applications, such as nonlethal weapons, fusion, plasma processing, propulsion, disinfection applications, and shock-wave mitigation.

However, current plasma sources have been unable to generate an air plasma with an electron density sufficient to protect against the consequences of the overpressure caused by a shockwave at atmospheric pressure. Furthermore, current plasma sources have been unable to generate self-containing or self-confining air plasmas that have lengthy lifetimes without the use of expensive and unwieldy support equipment or large magnets. Therefore, there remains a need for a versatile, scalable, and repeatable method and apparatus to generate air plasmas.

SUMMARY OF THE INVENTION

The present invention relates to a method and an apparatus for generating self-confined and self-stabilized air plasmas at atmospheric pressures. In particular, the method and apparatus generate toroidal air plasmas (TAPs) at atmospheric pressure having an electron density sufficient for a number of applications. The method and apparatus may be configured to generate TAPs at a high repetition rate.

The method includes generating a self-contained air plasma at an atmospheric pressure. The air plasma is generated in a first ignition region and restricted in radial expansion. The method also includes applying a high voltage pulse to the air plasma in a secondary ignition region to heat and accelerate the air plasma away from the second ignition region. Heating the air plasma causes the air plasma to expand and become self-contained.

The apparatus for generating a self-contained air plasma at an atmospheric pressure includes a primary ignition region that includes a first shielding material defining a first cavity, that may be elongated or another configuration, to contain a plasma source. The apparatus also includes an ignition device to generate the air plasma from the plasma source and a secondary ignition region that includes a second shielding material defining a second region, that may be elongated or another configuration, wherein the second cavity is in fluid communication with the first cavity to receive the air plasma. In one embodiment, the second region is defined, at least in part, by a wire mesh that allows a current to be discharged through the air therein and form a plasma discharge.

The apparatus includes a high voltage circuit that includes at least one capacitor and is in communication with a voltage source in order to apply a high voltage pulse to the air plasma. The high voltage pulse heats and accelerates the air plasma away from the apparatus to form the self-contained air plasma at the atmospheric pressure. In various other embodiments, the plasma source is at least one member of a group consisting of an exploding wire, an explosive, a puffed gas plasma, a hollow cathode plasma, a hypervelocity plasma source, a railgun, a microwave-driven plasma source, or other compact plasma source that can be directed into the second region. The plasma source may also be provided by a one or more laser-induced plasma channels.

In another embodiment, a method for generating a self-contained air plasma at an atmospheric pressure includes applying a first high voltage pulse across a wire to explode the wire and generate the air plasma in a first ignition region located between an anode and a cathode. The method also includes restricting radial expansion of the air plasma, such that the air plasma travels parallel to a longitudinal axis of the wire to a second ignition region between the cathode and an accelerator electrode. A second high voltage pulse is applied across the cathode and the accelerator electrode to heat the air plasma, wherein heating the air plasma causes the air plasma to expand, accelerate, and form a toroidal structure. The method also includes discharging the self-contained toroidal air plasma from the second ignition region at the atmospheric pressure.

The method further includes providing rigid electrically insulating materials between the anode and the cathode, as well as between the cathode and the accelerator electrode. The insulating materials define cavities, which may be elongated. The elongated cavity between the anode and the cathode receives the wire and restricts the radial expansion of the air plasma. The cavity between the cathode and the accelerator electrode allows the air plasma to expand. Both cavities may have generally cylindrical or spiral configurations. The cavities may have equal or different diameters and may be configured to increase or decrease the diameter of the toroidal plasma. In addition, the cavities may be configured to increase or decrease the velocity of the toroidal plasma.

In another embodiment, a method for generating a self-contained air plasma at an atmospheric pressure includes generating the air plasma in a first ignition region, directing a velocity of expansion of the air plasma out of the first region, and imparting energy to the air plasma in a secondary ignition region, wherein the imparted energy causes the air plasma to expand, accelerate out of the second ignition region, and become self-contained. Alternately, the method may include restricting radial expansion of the air plasma.

In various embodiments, the wire has a gauge in the range between 00 AWG and 80 AWG. In other embodiments, the first high voltage pulse is between 10 kV and 50 kV and has a duration between 0.1 μs and 200 ms, while the second high voltage pulse is between 100V and 300V or up to many thousands of volts and has a duration between 1 ns and 1000 ms.

In another embodiment, an apparatus for generating a self-contained air plasma at an atmospheric pressure includes a first shielding material positioned between an anode and a semi-permeable cathode in a primary ignition region. The first shielding material has a first longitudinal cavity to contain a conductive wire extended between and in communication with the anode and the cathode. The apparatus also includes a primary high voltage circuit with at least one voltage source and at least one capacitor. The primary high voltage circuit is in communication with the anode and the cathode to apply a first high voltage pulse across the wire causing it to explode and generate the air plasma. The first longitudinal cavity restricting radial expansion of the air plasma.

The apparatus also includes a secondary ignition region defined by a second shielding material positioned between the cathode and a semi-permeable electrode. The second shielding material has a second longitudinal cavity extending between the cathode and the electrode wherein the second longitudinal cavity is in fluid communication with the first longitudinal cavity to receive the air plasma. The apparatus also includes a secondary high voltage circuit with at least one other capacitor that is in communication the voltage source. The secondary high voltage circuit further communicates with the cathode and the electrode to apply a second high voltage pulse across the gap between the cathode and the electrode, wherein the second high voltage pulse further heats and accelerates the air plasma as it traverses the electrode to form the self-contained air plasma at the atmospheric pressure.

In various embodiments, the self-contained air plasma may be formed by a laser induced plasma and subsequently heated by a laser, a microwave pulse, or any means for imparting energy. The plasma formed in air is self-confined by electrostatic or electromagnetic fields and interactions. As such, the air plasma inherently has a long lifetime. The self-confined air plasma may have a lifetime on the order of milliseconds to multiple seconds or even minutes.

The density of the plasma may be increased by using a pressurization system that may increase the pressure in the apparatus to a range between 1 ATM-2000 ATM or higher. In addition, the air within and/or around the apparatus may be modified to optimize the size and electron density of the generated air plasmas. For example, the air within and/or around the apparatus may include one or more gas mixtures or gases seeded with nanoparticles or various chemical compounds.

In various embodiments, the self-contained air plasmas have an electron density of at least $10^{10}/cm^3$ and may be as high as $10^{19}/cm^3$. In addition, the geometry of the apparatus leads the air plasma to form a toroidal structure.

DETAILED DESCRIPTION OF THE INVENTION

The present invention relates to the generation of high-density air plasmas at atmospheric pressure that are sustainable for a sufficient duration and have an electron density sufficient to be used in a variety of applications. As used herein, an air plasma at atmospheric pressure refers to an air plasma having pressures substantially equal to the surrounding atmosphere. In addition, air plasmas at atmospheric pressure do not require specialized high-pressure or low-pressure vessels. In one aspect, the geometry of the air plasma generating apparatus gives rise to the shape and the self-containing nature of the air plasma. Once formed, the air plasmas are self-containing and do not require additional support equipment. For example, the air plasma generator may be configured to generate a toroidal air plasma (TAP). A TAP is an air plasma having a substantially toroidal shape.

For example, the generated air plasmas may be used for shock wave mitigation, used as fusion sources for Tritium-Tritium or Deuterium-Tritium reactions or any other advanced fusion cycle, or plasma capacitors. In addition, the generated air plasmas may be used in nonlethal applications, including but not limited to electroshock weapons, such as a Taser. The air plasmas may also be used for a number of industrial applications, including but not limited to: plasma surface modification including semiconductor processing, polymer modification, directed energy applications, microwave generation, energy storage and generation, UV generation for semiconductor manufacturing, plasma chaff, surface disinfection, and microwave channeling at a distance. The air plasmas may also be used as an ignition source for turbines, combustion engines, and rocket engines. The generated plasmas may also be used in other applications, for example, the generated air plasmas may be precursors to ball lightning.

The Air Plasma Generator Apparatus

Figure 1:
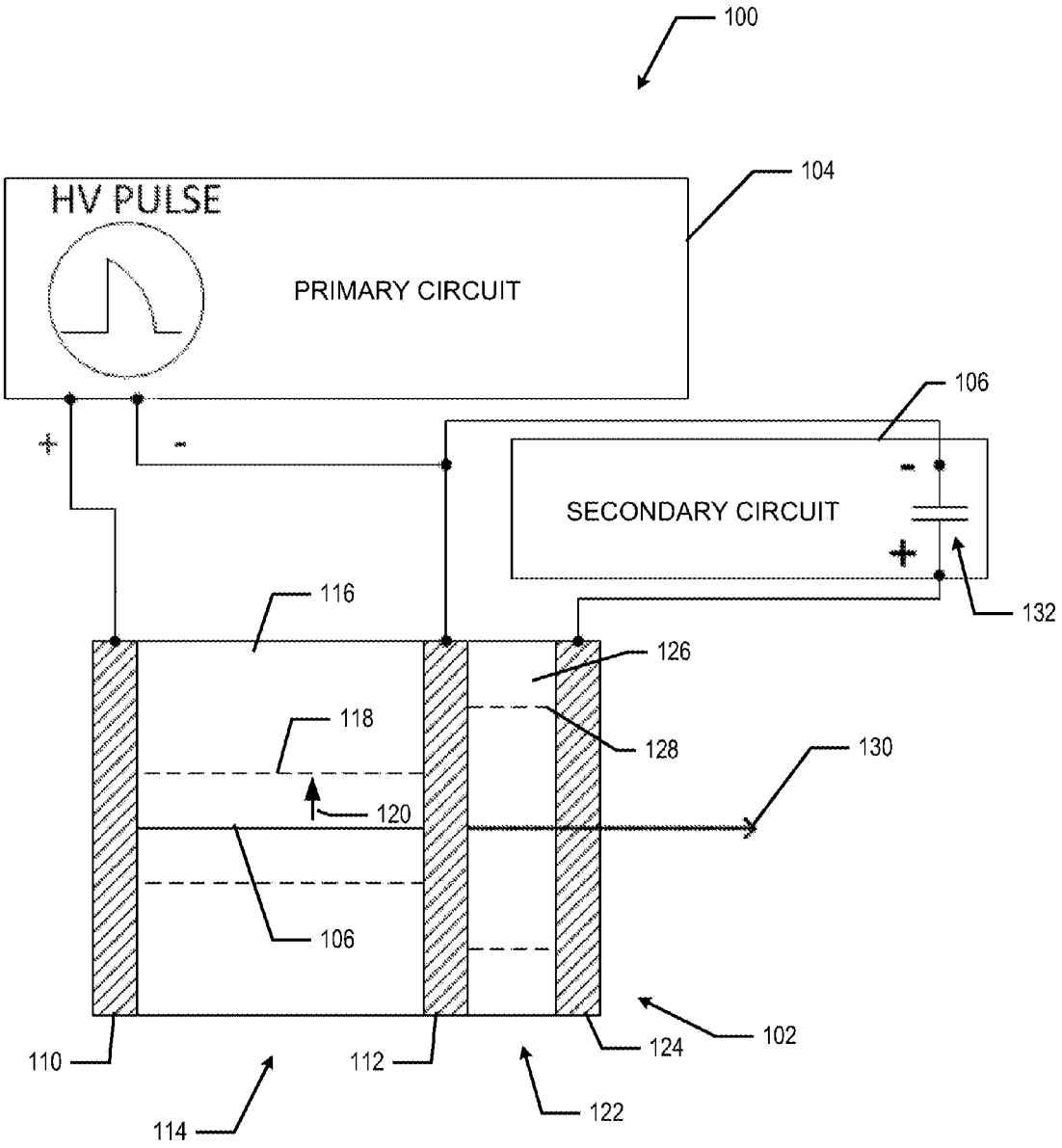
FIG. 1 depicts an embodiment of a toroidal air plasma generator.
Figure 2:
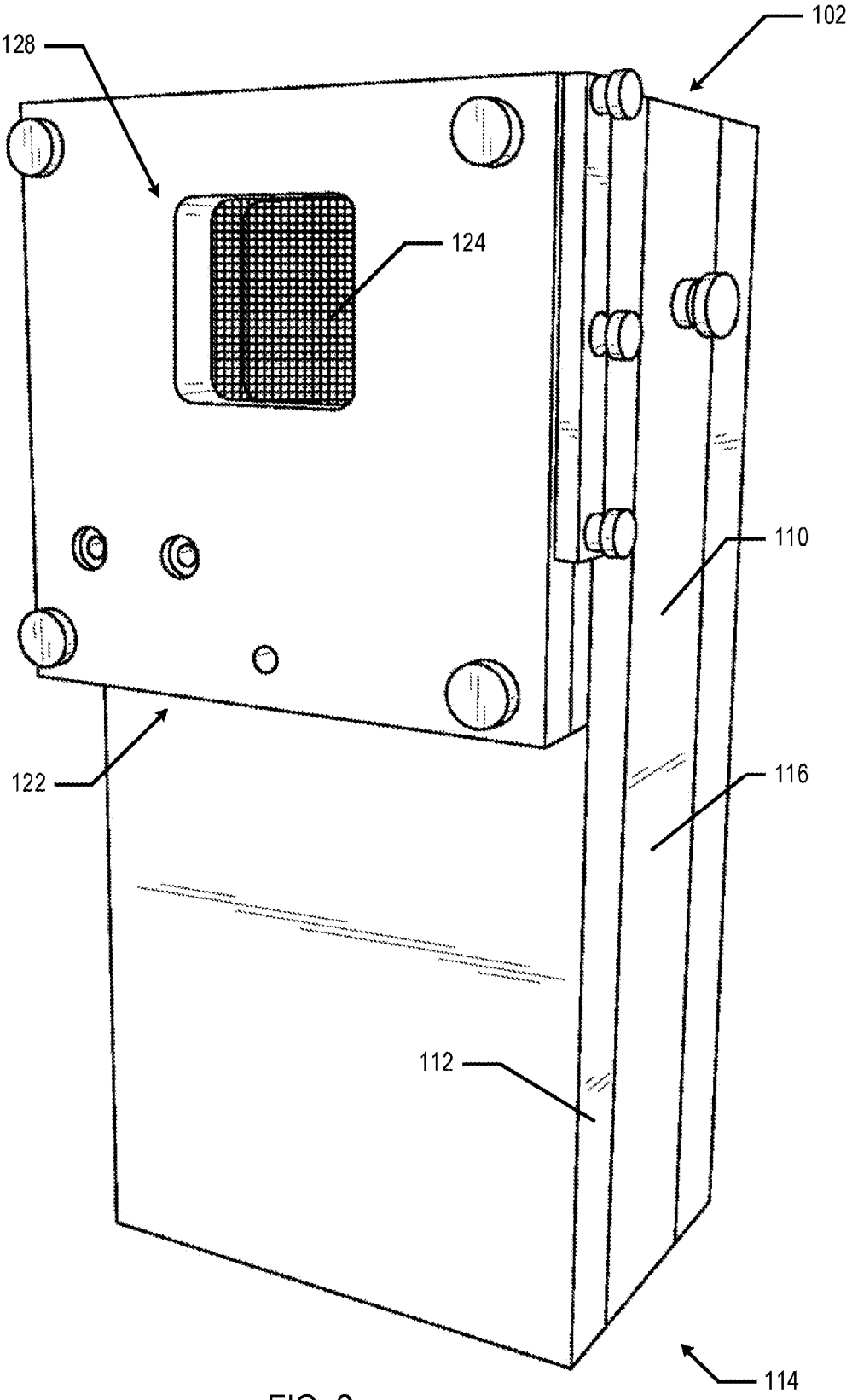
FIG. 2 is a photograph of one embodiment of the air plasma generation apparatus.
Figure 3:
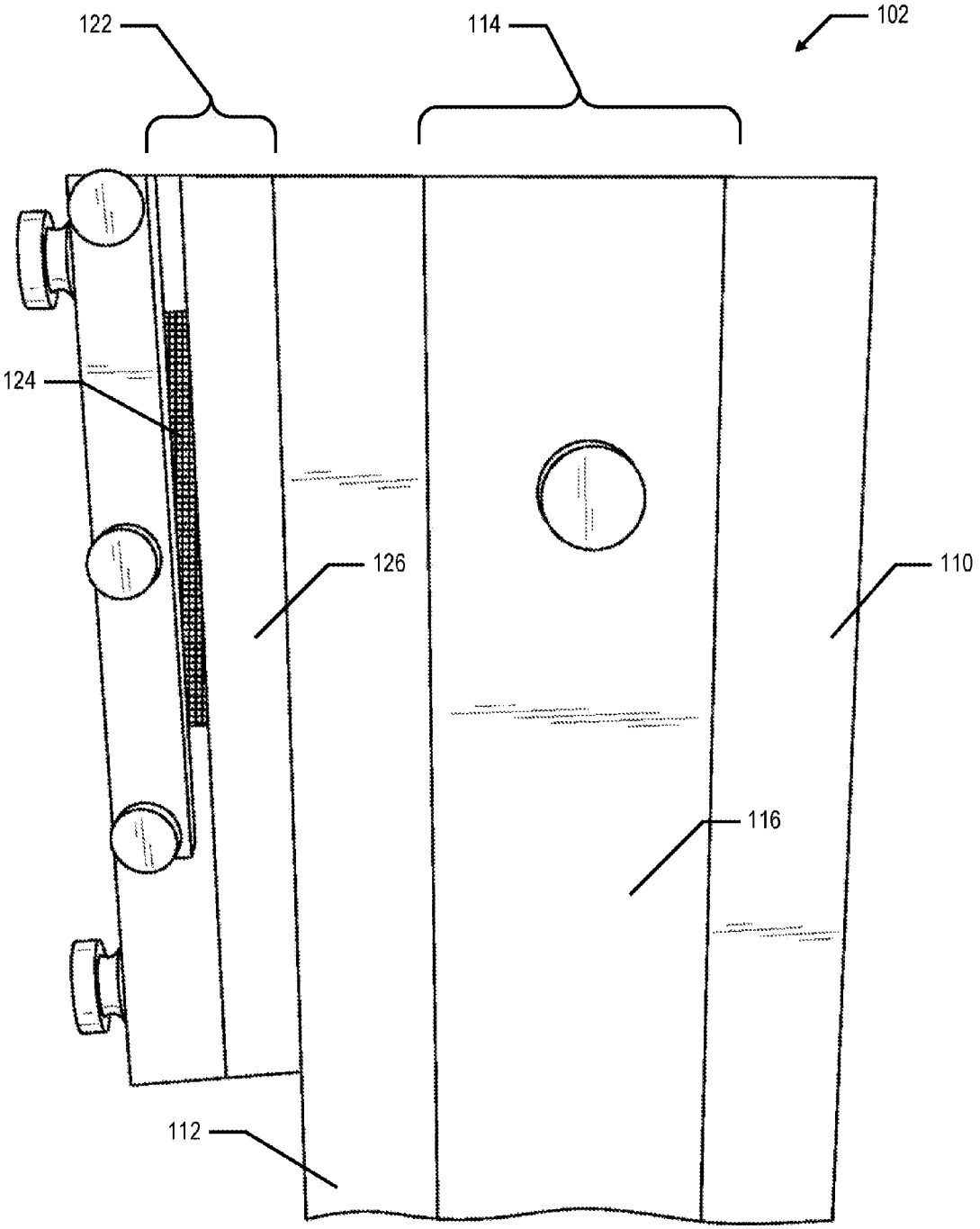
FIG. 3 is a side-view photograph of one embodiment of the air plasma generation apparatus FIG. 4. is a schematic layout of a primary high-voltage circuit according to one embodiment.

An embodiment of an air plasma generation apparatus 100 that generates a toroidal air plasma (TAP) is shown in FIGS. 1-3. The apparatus 100 includes an TAP generator 102 that is in electrical communication with a primary high-voltage circuit 104 and a secondary circuit 106.

The TAP generator 102 is capable of generating a TAP discharge, generally indicated as 130, that has a finite duration. According to one embodiment, the TAP generator 102 uses an exploding wire 108 to form the TAP discharge 130.

As shown, the exploding wire 108 may be formed of a single strand of wire positioned within the TAP generator 102. Alternately, the exploding wire 108 may consist of a single stand of wire that is woven or looped back and forth within the TAP generator 102, such that multiple lengths of the wire may be exploded simultaneously. In various other embodiments, the exploding wire 108 may consist of multiple stands of distinct or looped wires.

By way of example and not limitation, the exploding wire 106 may be a 40-gauge copper wire; however, any suitable wire that heats and vaporizes in air may be used. In other examples, the exploding wire 108 may be any gauge of wire ranging from 00 AWG to 80 AWG. In addition, the exploding wire 108 may be a solid wire, a plated wire, a wire that is doped with other materials, or a wire-clad in another material. The exploding wire 108 is suspended between an anode 110 and a cathode 112. To ignite the exploding wire 108, a high voltage current is applied across the anode 110 and a cathode 112 and through the wire 108. In various embodiments, the high voltage current superheats at least a portion of the exploding wire 108, thereby causing it to expand explosively.

The anode 110 and the cathode 112 define a primary ignition region 114 in which the exploding wire 108 is ignited. The primary ignition region 114 also includes a non-conductive primary shielding material 116 that fills a portion of the space between the anode 110 and the cathode 112. The primary shielding material 116 has a thickness equal to the spacing between the anode 110 and the cathode 112. In one example, the primary shielding material 116 may have a thickness between 5 cm and 20 cm; however, other thickness and spacing distances may be used. In one embodiment, the primary shielding material 116 defines an primary elongated cavity 118 that receives the exploding wire 108. The diameter of the elongated cavity is larger than the diameter of the exploding wire, such that the exploding wire 108 does not contact the primary shielding material 116, thereby allowing the exploding wire 114 to ignite in air at atmospheric pressure. The primary elongated cavity 118 restricts the radial expansion of air, as indicated by 120, within the elongated cavity following the explosion from the exploding wire 108. Restriction the radial expansion 120 of the air, along with the momentum from the explosion directs the velocity of expanding air out of the primary ignition region 114.

The composition of the exploding wire 108 may also contribute to the formation of the air plasma. By way of example and not limitation, the explosion of the wire 108 generates shockwaves of electrons, ions, plasmas, UV waves and/or metal particles, as well as a number of other conditions, which may augment the formation of the TAP discharge 130. The exploding wire 108 also generates a pressure pulse that imparts momentum to the gas molecules in a secondary ignition region 122 of the TAP generator 102. Similarly, the exploding wire 108 imparts energy and momentum to the TAP discharge 130 within the secondary ignition region 122.

In one embodiment, the primary elongated cavity 118 is generally cylindrical. In another embodiment, the primary elongated cavity 118 has a spiral configuration. Similarly, other configurations of the primary elongated cavity 118 may be used; however, in all embodiments, the TAP discharge 130 from the exploding wire 108 is substantially restricted to axial acceleration along the axis of the central axis of the elongated cavity in order to generate boundary conditions that help form and shape the TAP discharge 130 in the secondary ignition region 122.

The secondary ignition region 122 is defined, in part, by the cathode 112 and an accelerator electrode 124. In one embodiment, the cathode 112 and the accelerator electrode 124 are a semi-permeable materials, such as but not limited to a mesh or screen, such that the TAP discharge 130 may traverse the cathode and the accelerator electrode. By way of example and not limitation, the accelerator electrode 124 may be composed of stainless steel or any other semi-permeable conductive material.

The secondary ignition region 122 includes a secondary shielding material 126. The secondary shielding material 126 is non-conductive and may have the same composition as the primary shielding material 116. Alternately, the secondary shielding material 126 may have a different composition than the primary shielding material 116.

In one embodiment, secondary shielding material 126 has a thickness equal to the spacing between the cathode 112 and the accelerator electrode 124. In one example, the secondary shielding material 126 has a thickness ranging between approximately 2 mm and 2 cm depending upon the distance between the cathode 112 and the accelerator electrode 124; however other thickness and spacing distances may be used. The secondary shielding material 126 also defines a secondary cavity 128 that is axially aligned with the primary elongated cavity 118 of the primary shielding material 116.

In one embodiment, the diameter of the secondary cavity 128 is greater than the diameter of the primary elongated cavity 118 to allow the TAP discharge 130 to expand as it travels through or, alternately, is formed in and by the secondary ignition region 122. In another embodiment, the diameter of the secondary cavity 128 may be equal to or less than the diameter of the primary elongated cavity 118. Similarly, the length of the secondary cavity may be greater than, equal to, or less than the length of the first elongated cavity. In various other embodiments, the secondary ignition region 122 has multiple cavities that, optionally, may be aligned in parallel to one another and the primary elongated cavity 118.

While a single primary ignition region 114 and a single secondary ignition region 122 are shown in FIGS. 1-3, in other embodiments multiple ignition regions may be used to further amplify the effects of the TAP discharge 130. For example, multiple plasma sources may be ignited in multiple primary ignition regions and/or multiple secondary ignition regions may be used to amplify, accelerate, augment, and/or shape the TAP discharge 130.

In various embodiments, the diameters of the primary and secondary cavities can be formed or otherwise configured to increase or decrease the diameter of the air plasma and to increase or decrease the velocity of the air plasma. The geometry of the self-contained air plasmas may also be enhanced through optimization of the air plasma generation apparatus 100 and the surrounding environment. For example, the TAP generator may be configured to generate stable plasmoids or spheres of plasma similar to ball lightning.

The TAP generator 102 is electrically connected to a primary high voltage circuit 106 that is configured to deliver a high-voltage pulse to the anode 110 and the cathode 112. The TAP generator 102 is also electrically connected to a secondary circuit 106 configured to discharge energy through the plasma in the secondary ignition region 122.

The primary high voltage circuit 106 includes one or more capacitor banks, one or more high voltage power sources, and one or more high-voltage switches, and suitable pulse generating circuitry to deliver a high-voltage pulse across the anode 110 and the cathode 112. In one embodiment, the primary high voltage circuit 106 includes a capacitor bank energized to between approximately 2 kV and approximately 100 kV to deliver a high voltage pulse having a duration between about 10 ns and 200 ms pulse through the anode 110 and the cathode 112 to the exploding wire 108. In this embodiment, the anode 110 is solid or a semi-permeable conductor while the cathode 112 is semi-permeable conductor.

Figure 4:
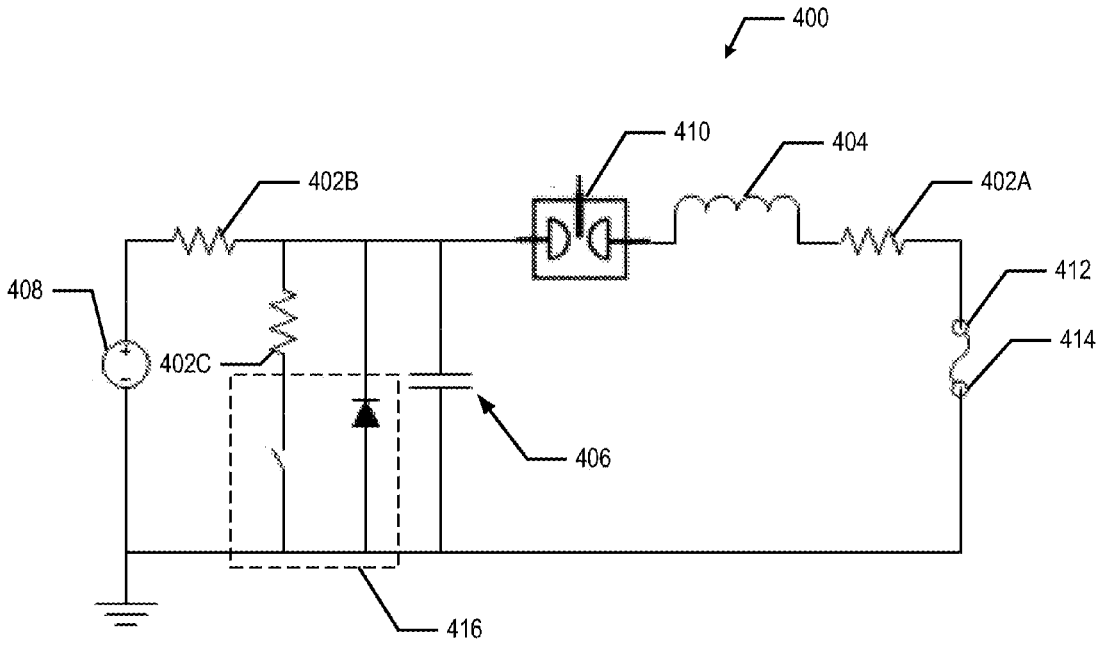

As shown in FIG. 4, a particular embodiment of the primary high voltage circuit 106 is an RLC circuit 400 that includes a number of resistors 402A-C, one or more inductors 404, and one or more capacitors or capacitor banks 406.

The primary high voltage circuit 106 also includes as a power source 408, a three-plate pressurized air gap switch 410, a lead 412 connected to the anode 110, another lead 414 connected to the cathode 112, and additional protection and safety circuitry, including but not limited to switches and diodes, generally indicated as 416.

In one embodiment, the power source 408 is a direct current (DC) power source that supplies approximately 30 kV to the primary high voltage circuit 106. The capacitor bank 406 has a capacitance of approximately 11 μF to store and release approximately 4.4 kJ generate a 6 kA, 46 μs current pulse (full-width half maximum) through the wire 108, causing the wire to explode. The inductor 404 is typically an 11.77 μH air-core inductor. The inductor 404 and a 5.5Ω aqueous-electrolyte shaping resistor 402A are used to shape the current pulse.

The circuit inductance and resistance are both variable parameters that affect the amount of current and energy delivered to and deposited into the wire 108. To determine the effects of circuit inductance on the current pulse delivered to the wire 108, the air core inductor 404, was replaced in various embodiments with other inductors having inductance values of 0.6 μH and 27.5 μH. Similarly, in other embodiments, the aqueous-electrolyte resistor was replaced with resistors having resistances of approximately 20Ω to approximately 300 mΩ. Non aqueous-electrolyte resistors may also be used.

When varying the inductance of the primary high-voltage circuit 104, a shaping resistor 402A with a resistance of approximately 5.2Ω was used. Likewise, the inductor 404 had a resistance of approximately 11.77 μH when the resistance of resistor 402A was varied.

The current pulse generated by the primary high-voltage circuit 104 with a typical 11.77 μH inductor 404 and a typical 5.2Ω shaping resistor 402A delivers approximately 6 kA with a pulse width of approximately 46.08 μs. It was observed that the peak and width of the current pulse varied with changes in inductance. For example, when the inductor 404 had an inductance of approximately 27.5 μH the current pulse delivered to the wire 104 had a peak current of approximately 5.48 kA and a pulse width of approximately 53.55 μs. While the current pulse generated when the inductor 404 had an inductance of 0.6 μH results in higher current (approximately 6.88 kA) delivered in a smaller pulse width (approximately 35.9 μs). As expected in view of traditional circuit theory, it was observed that the current pulse decreases in amplitude yet spreads in pulse width as the inductance increases. Further, it was observed that varying the inductance of the primary high-voltage circuit 104 did not result in a significant change in the height or duration of the TAP discharge 130. Similarly, no significant effect was observed in the distance traveled data by the TAP discharge 130. As such, the inductance of the primary high-voltage circuit 104 may be varied according to the desired application of the air plasma generation apparatus 100 without diminishing the generated TAPs.

Conversely, it was determined that varying the resistance in the primary high-voltage circuit 104, did however, affect the generated TAPs. For example, the current pulse from a typical configuration of the primary high-voltage circuit, where the resistance of the shaping resistor 402A is approximately 5.2Ω, is approximately 6 kA with a pulse width of approximately 46.08 μs. The current pulse, when the resistor 402A has a resistance of approximately 20Ω, however, reaches a peak of only about 2.02 kA with a pulse width of approximately 130.85 μs.

Further, by removing the typical aqueous-electrolyte resistor 402A from the circuit and directly connecting the inductor 404 to the anode 110, through lead 412, resulted in a stray resistance of approximately 300 mΩ. In this configuration, the primary high-voltage circuit 104 is underdamped, rather than the typical overdamped configuration. As such, the resultant current oscillates about four times in approximately 288 μs while reaching a peak of approximately 23.6 kA.

Changing the resistance of the resistor 402A yields appreciable differences in the size and the duration of the TAP discharge 130. For example, when the resistor 402A has a resistance of approximately 20Ω the TAP discharge 130 has a shorter duration and smaller diameter when compared to a shaping resistance of approximately 5.2Ω. Further, when the resistor 402A is removed or otherwise reduced to yield a resistance of approximately 300 mΩ, the TAP discharge 130 is approximately twice as large in diameter and has a longer duration when compared to TAP discharges with a 5.2Ω resistor. In additionally, the TAP discharge 130 generated with a 300 mΩ resistor for the shaping resistor 402A travels approximately twice as far as the TAP discharges generated using a 20Ω resistor or a 5.2Ω resistor for the shaping resistor. In this configuration, additional energy has been deposited into the TAP discharge 130 formed by the exploding wire 108. This results in an increase in the volume and duration of the TAP discharge 130 and may be caused, at least in part by the reduction in dampening of the primary high-voltage circuit 104.

Preferably, the secondary circuit 106 includes a capacitor bank charged to a voltage suitable for heating the TAP discharge 130. For example, when the secondary high voltage circuit 106 is charged to between 100V and 300V, the TAP discharge 130 entering the secondary ignition region 122 completes a circuit between the cathode 112 and the accelerator electrode 124. The energy imparted by the secondary high voltage circuit 106 enhances the duration and velocity of the TAP discharge 130. In one embodiment, the secondary high voltage circuit 106 is connected to the same high voltage power source as the primary high voltage circuit 106. In another embodiment, the secondary high voltage circuit 106 is powered by another high voltage source. In yet another embodiment, the primary high voltage circuit 106 and the secondary high voltage circuit 106 may be incorporated into a single high voltage system.

By way of example and not limitation, the secondary circuit 106 may include a secondary 8.8 mF electrolytic capacitor bank 132 that is charged to approximately 250 V to heat the plasma in the secondary ignition region 122. The post-explosion heating has been shown to enhance both the size and duration of the TAP discharge 130.

Figure 5:
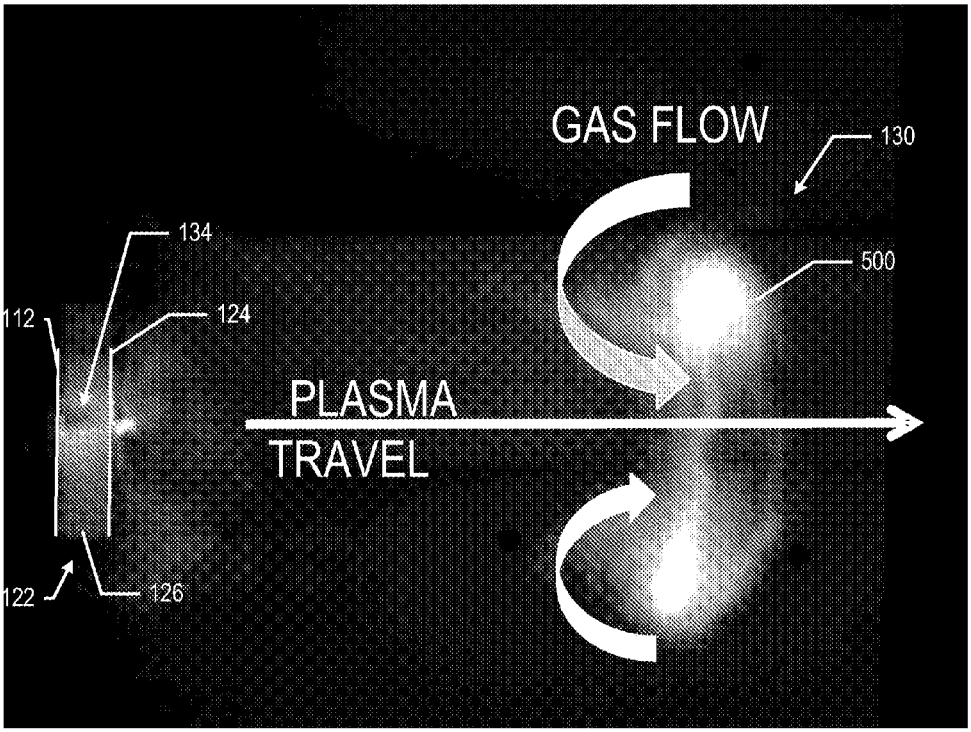
FIG. 5 is a high-speed image of a toroidal air plasma according to one embodiment.

The additional heating provided by the secondary circuit 106 also plays a role in forming the toroidal shape of the TAP discharge 130. For example, the elongated cavity 128 defined by the secondary shielding material 126 allows for the plasma generated by the explosion of the wire 104 to expand. During expansion, when the area between the cathode 112 and the accelerator anode 124 is filled with plasma, the secondary capacitor bank 132 discharges stored energy through the plasma. In one embodiment, a 400 A current drawn by the plasma from the secondary capacitor bank 132 has a pulse width of approximately 4 ms. After the discharge from the secondary capacitor bank 132, the bulk of the TAP discharge 130 detaches from a portion 134 of the discharge that remains in the secondary ignition region 122 and exits from the TAP generator 102, as shown in FIG. 5. After the bulk of the TAP discharge 130 has separated from the remaining portion, the capacitor bank 132 may continue to discharge and energize the remaining plasma in the TAP generator 102.

A cross sectional view of the evolution of the toroidal structure 500 of the TAP discharge 130 is shown in FIG. 5. For approximately the first millisecond after ignition, the discharge 130 is still expanding from the secondary ignition region 122 and has a very homogeneous profile. Approximately 1.5 ms after ignition, the toroidal shape begins to form. These two images illustrate the toroidal shape of the discharge at 6 ms and 7 ms after ignition. FIG. 5 also shows the remaining discharge 134 within the secondary ignition region 122.

In one embodiment, the TAP discharge 130 can last up to 15 ms while travelling approximately 30 cm from the TAP generator 102. In other embodiments, the TAP discharge 130 may have a lifetime in the range of milliseconds to multiple seconds and multiple minutes. The toroidal structure 400 of the TAP discharge 103 may expand to approximately 12 cm in diameter. In other embodiments, the toroidal structure 400 may expand to other diameters including those less than or greater than 12 cm. The electron density of the TAP is preferably at least $10^{10}/cm^3$ and may be as high as $10^{19}/cm^3$. In various embodiments, the electron density is determined to be approximately $10^{14}$-$10^{15}/cm^3$ based upon the measured current passing through the plasma while it is in the secondary ignition region 122.

The density of the plasma may be increased by using a pressurization system (not shown) that may increase the pressure in the apparatus to a range between 1 ATM-2000 ATM or higher. In addition, the air within and/or around the apparatus may be modified to optimize the size and electron density of the generated air plasmas. For example, the air within and/or around the apparatus may include one or more gas mixtures or gases seeded with nanoparticles or various chemical compounds.

In various embodiments, the radial expansion 120 of the shock wave and heat generated by the explosion of the wire 108 is confined within the primary and secondary cavities 118 and 128, respectively. The discharge from the exploding wire 108 is thus dissipated, predominantly, through axial expansion along the axis of the primary elongated cavity 118 and the secondary cavity 128. This imparts hydrodynamic effects upon the TAP discharge 130 and therefore, the geometry of the TAP generator 102 lends itself to the self-containing characteristics of the TAP discharge 130.

The combined effects of the initial axial expansion from the exploding wire 108 and the secondary excitation in the secondary ignition region 122 result in the formation of the toroidal structure 400. In various other embodiments, the secondary ignition region 122 may have any geometry that can transfer energy into the TAP discharge 130. In these embodiments, the temperature and subsequent absorption and emission of light by the TAP discharge 130 can be tailored to specific requirements based upon the geometry of the secondary ignition region 122. The duration and amount of energy delivered to the plasma in the secondary ignition region 122 can be optimized to generate characteristics of the TAP discharge 130 that are required for the desired application. For example, by increasing the energy imparted to the TAP discharge in the secondary ignition region 122, the lifetime of the TAP discharge may be extended from milliseconds to minutes thereby allowing the long-range projection of the plasma.

Although the TAP generator 102 has been described using the exploding wire 108 as the initial plasma source, other plasma sources may be used. By way of example and not limitation, other plasma sources include explosives, puffed gas plasmas, hollow cathode plasmas, microwave driven sources, high power laser arrays, railguns, hypervelocity plasma accelerators, and any other plasma source that has a high repetition rate to generate ionized particles. In these embodiments, the plasma source is activated by a suitable activation device corresponding to the plasma course. For example, an activation device for an explosive is a detonator, while an activation device for a microwave driven source is a microwave generator.

In another example, one or more lasers is used to form or further heat the TAP discharge 130. For example, a laser may be used to form a laser-induced air plasma in the primary ignition region 114. Alternately, a laser may be used to heat a plasma discharge within the secondary ignition region 122.

In various embodiments, the air plasma generation apparatus 100 is configured for single or multi-shot operation. As such, the air plasma generation apparatus 100 may generate a single or multiple self-contained air plasmas at a high rate of repetition.

The Toroidal Air Plasma

Figure 6A:
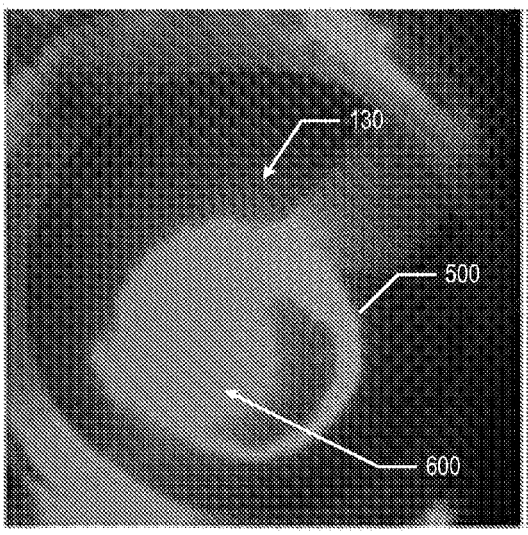
FIGS. 6A and 6B are photographs providing a cross sectional view of the formation of a toroidal air plasma according to one embodiment.
Figure 6B:
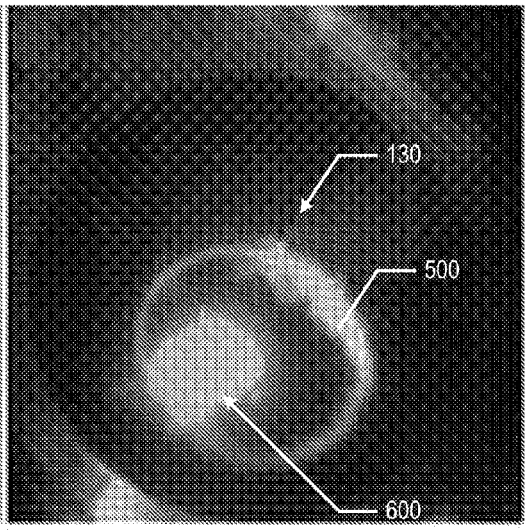

The TAP discharge 130 has a very homogenous profile immediately after the ignition of the exploding wire 108 as it expands from the first primary elongated cavity 118. In one embodiment, the TAP discharge 130 begins to take on the toroidal structure 400 approximately 1.5 ms after ignition. The toroidal structure 400 of the TAP discharge 200 is shown at approximately 6 ms and approximately 7 ms after ignition in FIGS. 5A and 5B, respectively. FIGS. 6A and 6B also show the secondary ignition 600 of the TAP discharge 130 within the secondary ignition region 122. When the TAP discharge 130 exits the TAP generator 102, the discharge has a circulating current or field reversal that generates a self-magnetic field as well as a rotating plasma region on the minor radius of the toroid structure 400. The self-magnetic field confines the TAP discharge 130 and significantly increases the lifetime of the TAP discharge to effectively produce a self-sustaining TAP discharge by reducing interactions that may recombine molecules of the air plasma with atmospheric gas molecules.

In various embodiments, the TAP discharge can be sustained for approximately 2-30 ms and may travel approximately 10-40 cm away from the TAP generator 102 at up to 200 m/s. The toroidal shape 500 may expand up to approximately 12 cm in diameter. The electron density of the TAP discharge 130 is approximately $10^{14}$-$10^{15}/cm^3$ as determined by the measured current passing through the TAP discharge 130 during the secondary heating of the discharge in the secondary ignition region 122. In various other embodiments, the TAP discharge 130 is scalable to higher energies, densities and can be used for a number of advanced applications.

For example, 1 kilojoule to 1 gigajoule or higher of energy may be imparted to the TAP discharge 130 in the secondary ignition region 122. Increasing the energy will increase the lifetime of the TAP discharge 130 from an order of milliseconds to minutes allowing for the long-range projection of the TAP discharge.

Figure 7:
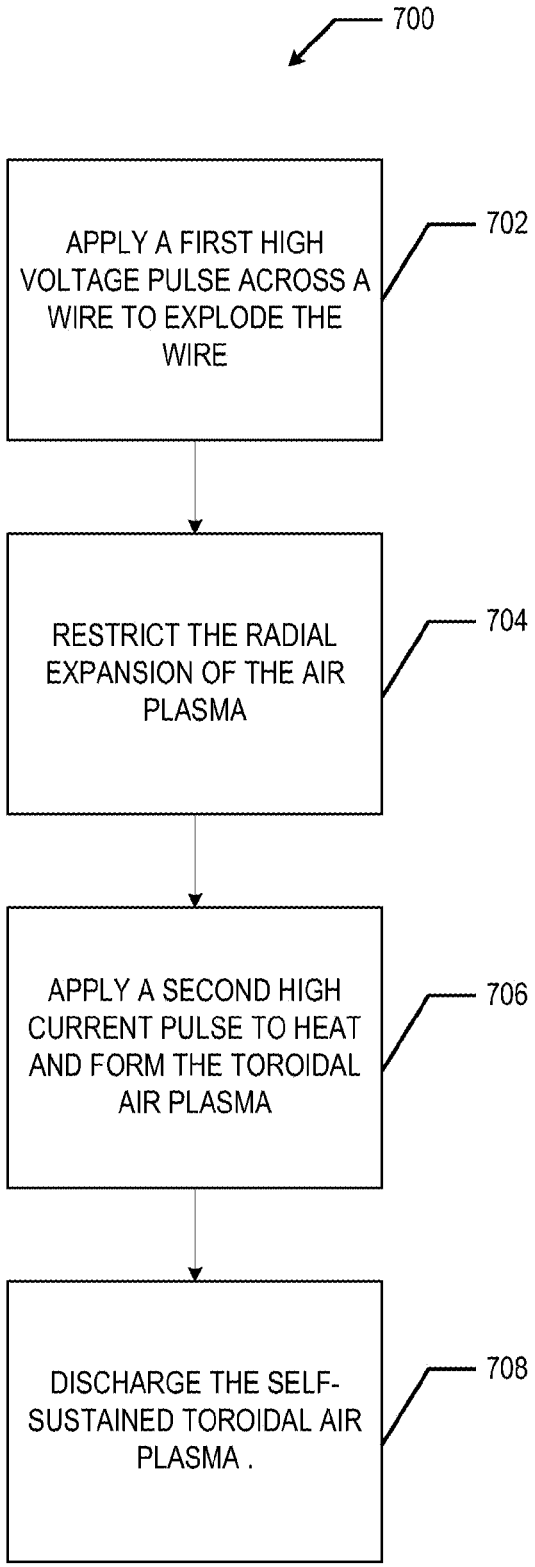
FIG. 7 is a flowchart depicting a method to form a toroidal air plasma according to one embodiment.

FIG. 7 is a flowchart illustrating one embodiment of a method 700 for generating a TAP discharge 130. At step 702, a first high voltage pulse is applied across the anode 110, the cathode 112, and the exploding wire 108 in the primary ignition region 114. The first high voltage causes the wire to explode thereby producing the TAP discharge 130. At step 704, the radial expansion of the AP discharge is restricted such that the TAP discharge travels along the longitudinal axis of the wire to a second ignition region defined by the cathode 112 and the accelerator electrode 124.

In the second ignition region 122, a second high voltage pulse is applied across the cathode 112 and the accelerator electrode 124 to further heat and expand the TAP discharge 130, at step 706. Within the secondary ignition region 122, the TAP discharge becomes self-sustaining and takes on the toroid structure 200. At step 708, the self-contained TAP discharge is discharged from the second ignition region 122, wherein it may be used to mitigate the effects of a shock wave or another propagating wave.

Example Method for Generating a Toroidal Air Plasma

By way of example and not limitation, an exemplary method for generating a TAP discharge, such as the discharge 130 is provided. The primary high voltage circuit 104 of the air plasma generation apparatus 100 included an 11 μF capacitor bank energized to approximately 30 kV to deliver a 4 kA pulse for a duration of approximately 200 μs pulse through two strands of 40 AWG silver-plated copper wire 108 within the TAP generator 102. The anode 110 connected to the wire 108 was a copper screen while the cathode 112 was a stainless steel screen. The primary shielding material 116 was a polycarbonate material having a thickness of approximately 10 cm and the elongated cavity 118 had a diameter of approximately 1.25 cm.

The secondary circuit 106 used an 8.8 mF electrolytic capacitor bank 132 charged to 250V to heat the TAP discharge 130. The secondary primary shielding material 126 was plastic approximately 7 mm thick and defined another elongated cavity 128 with a diameter of approximately 3 cm. The secondary circuit 106 discharged approximately 400 A into the TAP discharge 130 over approximately 4 ms. The TAP discharge 130 exiting the TAP generator 102 has an electron density of approximately $10^{16}$-$10^{17}$/cm$^3$ as determined by the measured current that passed through the discharge during the secondary heating.

It will be appreciated that the device and method of the present invention are capable of being incorporated in the form of a variety of embodiments, only a few of which have been illustrated and described above. The invention may be embodied in other specific forms without departing from its spirit or essential characteristics. The described embodiments are to be considered in all respects only as illustrative and not restrictive and the scope of the invention is, therefore indicated by the appended claims rather than by the foregoing description. All changes which come within the meaning and range of equivalency of the claims are to be embraced within their scope.

What is claimed is:

1. A method for generating a self-contained toroidal air plasma at an atmospheric pressure comprising:

generating the air plasma in a first ignition region;

restricting radial expansion of the air plasma in the first ignition region; and, applying a high voltage pulse to the air plasma in a secondary ignition region, wherein the high voltage pulse causes the air plasma to expand in the secondary ignition region, accelerate out of the second ignition region, and become self-contained.

2. The method of claim 1, wherein the air plasma is generated from a plasma source and the plasma source is at least one member of a group consisting of an exploding wire, an explosive, a puffed gas plasma, a hollow cathode plasma, a laser, a railgun, a hypervelocity plasma source, and a microwave-driven plasma source.

3. The method of claim 1, wherein restricting radial expansion of the air plasma further comprises:

providing a shielding material around the air plasma source that focuses expansion of the air plasma in a direction parallel to a longitudinal axis of the first ignition region and the second ignition region.

4. The method of claim 1, wherein applying the high voltage pulse to the air plasma further comprises:

applying the high voltage pulse across a cathode and an electrode separated by an air gap, wherein the air plasma completes a circuit between the cathode and the electrode.

5. The method of claim 4, wherein the air plasma accelerates away from the cathode and the electrode and forms the self-confining toroidal structure at the atmospheric pressure.

6. The method of claim 5, wherein the self-confining toroidal structure degenerates into a spherical structure.

7. The method of claim 1, wherein the self-contained toroidal air plasma has an electron density of at least $10^{10}$/cm$^3$.

8. An apparatus for generating a self-contained toroidal air plasma at an atmospheric pressure comprising:

a primary ignition region comprising a first shielding material that defines a first longitudinal cavity to contain a plasma source;

an ignition device in communication with the primary ignition region to generate an air plasma from the plasma source;

a secondary ignition region adjacent to the primary ignition region, the secondary ignition region comprising a second shielding material that defines a second longitudinal cavity, wherein the second longitudinal cavity is in fluid communication with the first longitudinal cavity to receive the air plasma; and a high voltage circuit comprising at least one capacitor, the high voltage circuit in communication with a voltage source to apply a high voltage pulse to the air plasma, wherein the high voltage pulse heats and accelerates the air plasma away from the apparatus to form the self-contained toroidal air plasma at the atmospheric pressure.

9. The apparatus of claim 8, wherein the plasma source is at least one member of a group consisting of an exploding wire, laser, an explosive, a puffed gas plasma, a hollow cathode plasma, a railgun, a hypervelocity plasma source, and a microwave-driven plasma source.

10. The apparatus of claim 8, wherein the second longitudinal cavity is cylindrical and the air plasma forms a self-confining toroidal structure at the atmospheric pressure.

11. The apparatus of claim 10, wherein the self-confined toroidal structure degenerates to a spherical structure.

12. The apparatus of claim 8, wherein the self-contained toroidal air plasma has an electron density of at least $10^{10}$/cm$^3$ or higher.

13. A method for generating a self-contained toroidal air plasma at an atmospheric pressure comprising:

generating the air plasma in a first ignition region;

directing a velocity of expansion of the air plasma out of the first region; and, imparting energy to the air plasma in a secondary ignition region, wherein the imparted energy causes the air plasma to expand, accelerate out of the second ignition region, and become self-contained.

14. A method for generating a self-contained toroidal air plasma at an atmospheric pressure comprising:

generating the air plasma in a first ignition region;

restricting radial expansion of the air plasma; and, imparting energy to the air plasma in a secondary ignition region, wherein the imparted energy causes the air plasma to expand, accelerate out of the second ignition region, and become self-contained.

15. A method for generating a self-contained air plasma at an atmospheric pressure in an open air apparatus comprising:

generating the air plasma in a first ignition region;

restricting radial expansion of the air plasma in the first ignition region; and, applying a high voltage pulse to the air plasma in a secondary ignition region, wherein the high voltage pulse causes the air plasma to expand in the secondary ignition region, accelerate out of the second ignition region, and become self-contained.

* * * * *